United States Patent [19]
Hicks

[11] 4,318,237
[45] Mar. 9, 1982

[54] LIGHT DISPLAY UNIT

[75] Inventor: David W. Hicks, P.O. Box 5922, Arlington, Tex. 76011

[73] Assignee: David Hicks, Rockport, Tex.

[21] Appl. No.: 196,854

[22] Filed: Oct. 14, 1980

[51] Int. Cl.[3] ..... G09F 13/00
[52] U.S. Cl. ..... 40/502
[58] Field of Search ..... 40/502, 564, 152.2, 40/567

[56] References Cited

U.S. PATENT DOCUMENTS

| | | | |
|---|---|---|---|
| 754,190 | 3/1904 | Bechtold | 40/502 |
| 1,915,236 | 6/1933 | Messner et al. | 40/502 |
| 2,553,160 | 5/1951 | Arps | 40/502 |
| 3,345,766 | 10/1967 | Timlin | 40/502 |

FOREIGN PATENT DOCUMENTS

| | | | |
|---|---|---|---|
| 931422 | 10/1956 | Fed. Rep. of Germany | 40/502 |

*Primary Examiner*—Gene Mancene
*Assistant Examiner*—Wenceslao J. Contreras
*Attorney, Agent, or Firm*—Hubbard, Thurman, Turner, Tucker & Glaser

[57] ABSTRACT

Apparatus for illuminating color print photographs in which a light source is mounted along the axis of rotation of a display cabinet having transparent or translucent upstanding sides on which are mounted color photograph prints so that light from the light source passes through the color photo prints and creates a glowing pictorial display.

1 Claim, 4 Drawing Figures

LIGHT DISPLAY UNIT

BACKGROUND OF THE INVENTION

The invention relates to apparatus for displaying illuminated pictures. But more particularly, the invention relates to a device in which a plurality of enlarged color photographs may be successively presented for viewing such that each photograph is continually illuminated by the same light source.

There are many known display devices in which stationary light sources and translucent screens are used to produce an image on a screen. An example of such a device is set forth in U.S. Pat. No. 1,881,417. However, this device does not use an actual enlarged color photograph on standard photographic paper removably placed upon the screen so that it is illuminated from behind. In addition, the device shown in U.S. Pat. No. 663,430, while showing a means for throwing light upon the rear of a picture, clearly contemplates that the picture is to be obscured, rather than enhanced, by the back lighting.

The invention relates to improvements in apparatus of the type described in the said patents, which improvements provide a rotating display on which enlarged color photographs printed on standard photographic print paper may be mounted on upstanding transparent or translucent surfaces for an enhanced visual appeal. A plurality of such pictures may be displayed during one revolution of the supporting framework for the photo display as such framework is rotated about a central light source.

Accordingly, one object of the invention is to provide a rotating, illuminated display apparatus which provides a plurality of different color photographs available during each of the successive cycles of operation, each of which photographs are illuminated by a single light source positioned along the axis of rotation. A further object of the invention is to produce the desired display with a relatively simple and inexpensive apparatus.

SUMMARY OF THE INVENTION

In the preferred embodiment of the invention, a lamp is positioned at the vertical axis of a rotating box having four upstanding side walls, each side wall consisting of two panes of glass slidably inserted into grooves positioned at corners of the supporting structure so that a sheet of photographic paper having an image thereon may be sandwiched between such glass panes and inserted along with the glass panes into the grooves of the supporting structure and secured therein for rotation about a central axis.

The display box has a cover adapted to fit over the supporting structure and secure the upstanding side wall therein. The cover is removable and provides access to the centrally located light source within the supporting structure.

Rotation of the supporting structure is provided by means of a sliding ring riding on ball bearings around a circular track upon a stationary base.

Affixed to the center of the stationary base is an electric wire and socket holding a low wattage light bulb in a central position relative to the plurality of upstanding display walls so that the display walls can be rotated around the light bulb as the slip ring glides upon the ball bearings in the circular track upon the stationary base.

Other objects and advantages of the invention will be readily apparent from the following detailed description of the preferred embodiments thereof, which description should be considered in conjunction with the accompanying drawings, and claims.

DETAILED DESCRIPTION OF THE PREFERRED EMBODIMENT

Figure 1:
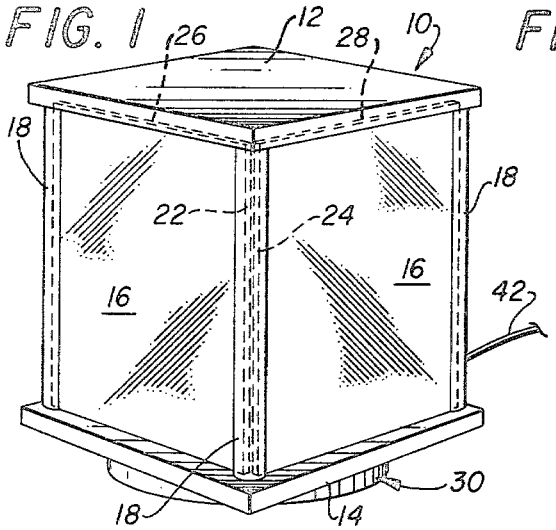
FIG. 1 is a view in perspective of the photo display unit of the present invention.
Figure 2:
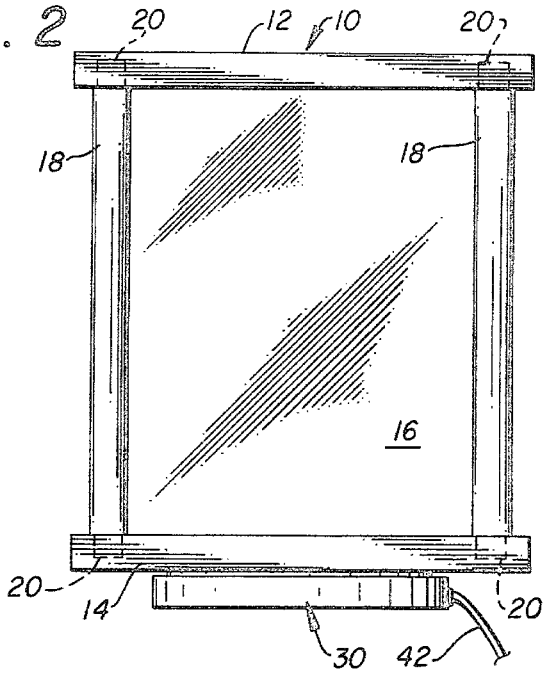
FIG. 2 is a front elevational view illustrating the way in which the support structure is attached to the stationary base of the present invention.

Referring to the drawings, wherein like numerals represent like parts throughout the several views, the photo display unit of the present invention is designated generally as 10. The preferred embodiment of the invention illustrated in FIGS. 1 and 2 comprises a cubic enclosure having opaque top and bottom walls 12 and 14 and removable vertical side walls formed by transparent panels 16. Each of panels 16 is flat, so that their surfaces lie in flat planes, and they may be made of glass, or Plexiglas. Panels 16 are shown secured at their vertical corners by vertically grooved posts 18.

Top and bottom walls 12 and 14 are drilled to receive posts 18 in channels 20 (shown in phantom) one of which is located at each corner of said top and bottom walls 12 and 14. Two longitudinal slots 22 and 24 (shown in phantom) extend the length of posts 18. These slots 22 and 24 are disposed depthwise perpendicularly of each other and of a width and depth sufficient to secure panels 16. Slots 26 and 28 (shown in phantom) connect post hole channels 20 in top wall 12.

Each of slots 26 and 28 are of a width and depth adequate to receive and secure panels 16 therein. Slots substantially identical to 26 and 28 connect channels substantially identical to channel 20 at each corner of rectangular top wall 12. Top and bottom walls 12 and 14, along with posts 18, may be constructed of any convenient material including particle board, wood, or plastic. The finish to be applied to the surfaces of these times creates a wood grain appearance in the preferred embodiment. The composition and finish of stationary base 30 conform in the preferred embodiment to the composition and finish applied to top and bottom walls 12 and 14.

Figure 3:
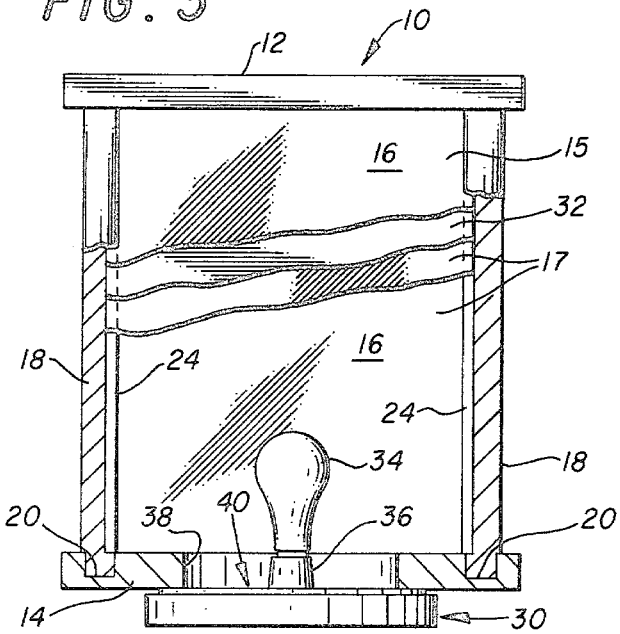
FIG. 3 is a view partially cut away showing the position of the internal light source of the present invention.

With reference now to FIG. 3, a cutaway of the preferred embodiment 10 is shown. It may be seen that transparent panels 16 are composed of two separate sheets 15 and 17 of transparent material. Sheets 15 and 17 may be removed from post slots 22 and 24 when top wall 12 is lifted from light display unit 10. After removal, sheets 15 and 17 may be separated so that a photograph on color print paper 32 may be inserted therebetween. Photo print 32 between sheets 15 and 17 may then be introduced from the top into slots 22 and 24 sliding downward until panel 16 (as a unit) stops snugly against bottom wall 14. Top wall 12 is then fitted to light display unit 10 so that panels 16 are nested within top wall slots 26, 28 or other slots not shown.

The size of photograph 32 is equal to that of panel 16 so that a narrow edge of photo print 32 is hidden within slots 22, 24, and 26. This feature prevents the escape of light from around the edges of the photograph during periods of display.

FIG. 3 also indicates the disposition of light source 34 within display unit 10 in the preferred embodiment. Light source 34 is an ordinary low wattage electric light bulb connected to a power source (not shown) by means of socket 36.

Light source 34 communicates with the interior of display unit 10 by means of a hole defined by interior cylindrical rim cut out of bottom wall 14. The hole created by cylindrical rim 38 is of a size adequate to allow introduction of light source 34 while maintaining contact with stationary base 30.

Below bottom wall 14 is shown circular rotating track 40 having an outer edge size defined by a circle whose radius is substantially greater than the circle defining the top edge of cylindrical rim 38. Circular rotating track 40 is in frictional contact with the underside of bottom wall 14. Other than circular rotating track 40, there is no contact between bottom wall 14 and stationary base 30.

Figure 4:
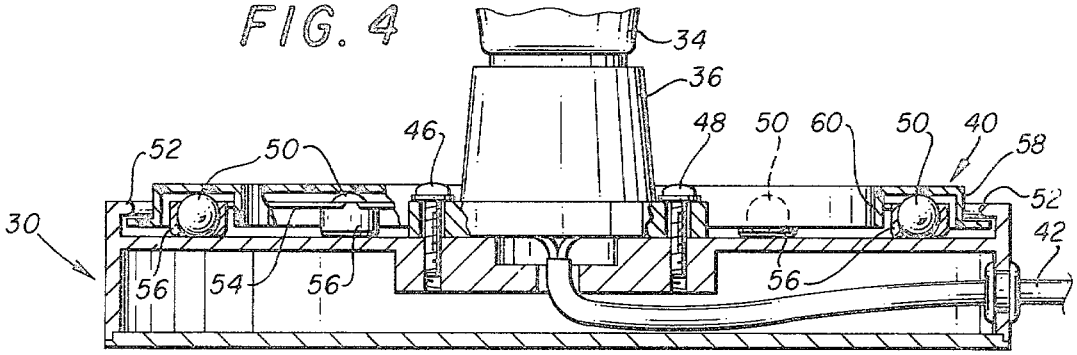
FIG. 4 is a cross sectional view of the stationary platform showing the sliding ring rotational means.

Referring now to FIG. 4, stationary base 30 is shown separated from display unit 10. Light source 34 and socket 36 are shown centrally located on stationary base 30. Power cord 42 is shown passing from the center of stationary base 30 within an interiorly disposed passage communicating with an outside cylindrical upstanding edge of stationary base 30. From there, the cord is connected to a power source (not shown). Socket 36 is shown secured to stationary base 30 by means of screws 46 and 48.

Circular rotating track 40 is shown riding on bearings 50 (in phantom). Circular rotating track 40 is composed of a smooth plastic. It is positioned and held in rotating relationship with stationary base 30 by means of edge tabs 52. Bearings 50 are spaced apart at regular intervals by spacer ring 54. Spacer ring 54 has a plurality of receptacles 56 for holding bearings 50 so that said bearings are exposed at opposite spherical poles. Spacer ring 54 is held within circular track 40 by downward extending cylindrical rims 58 and 60 of circular track 40.

Circular track 40 is of a type commonly found on "lazy susan" condiment trays.

Although sheet 15 of panel 16 has been described as transparent in this preferred embodiment, it will be apparent to those skilled in the art that this sheet may also be translucent without effecting the quality of the results achieved. It may also be appreciated that a photo may be applied directly onto panel 16 without the use of photographic print paper. In addition, light unit 10 may have more than four posts 18 and panels 16. For example, top and bottom walls 12 and 14 may be cut and hexagonally shaped for positioning six posts and six panels to form vertical translucent side walls for the display of six photographs. In fact, the number of photographs that can be displayed on a device employing the principles set forth herein is limited only by a practical maximum size for the light display unit.

Although panels 16 have been shown as flat vertical side walls, it will be apparent to those skilled in the art that color photo transparencies could be displayed on curved surfaces of a cylindrically shaped light display unit having an internal light source rotatable upon a stationary base.

It will be apparent to those skilled in the art that other modifications may be made without departing from the principals of the invention exemplified by the preferred embodiment of the invention which has been illustrated and described.

What is claimed is:

1. Device for the display of graphic art, which comprises:

an enclosure structure having the shape of a polyhedron;

a light source within the enclosure;

at least one plane face of translucent material having dimensions equal to at least one side of the enclosure on the enclosure so that light from the light source may pass through the plane face of translucent material;

a stationary base having top and bottom sides;

a rotatable means for supporting said enclosure on said stationary base;

at least one translucent piece of graphic art;

a plane face of transparent material having dimensions equal to said plane face of translucent material;

four posts having first and second ends severally extending along the lines defined by the intersection of sides of the polyhedral enclosure;

a groove cut longitudinal of each of such posts as defined at least one side of said polyhedral enclosure so that any pair of such grooves are depthwise coplanar with and receive each to itself an edge of said plane face of translucent material, said plane face of transparent material, and said translucent piece of graphic art and so that said graphic art is held between said plane face of translucent material and said plane face of transparent material with the said plane face of transparent material situated on the outer most side with respect to the interior of said enclosure;

four edges of a first generally square surface having one cylindrical recess at each corner thereof for receiving the first ends of said posts;

four edges of a second generally square surface having one cylindrical recess at each corner thereof for receiving the second ends of said posts;

a cylindrical edge defining a circular hold through the center of said second generally square surface;

said light source comprising a light bulb and electric socket attached to said stationary base and oriented so that the light bulb may extend upward through said second generally square surface at the hole defined therein;

a circular rotating track held in sliding engagement with the top of said stationary base;

a raised ring on said circular rotating track for engaging said second generally square surface abaxial of the hole defined in said second generally square surface; and bearing means for reducing friction between the circular rotating track and the top of said stationary base.

* * * * *